US005833195A

United States Patent [19]

Haynes

[11] Patent Number: 5,833,195

[45] Date of Patent: Nov. 10, 1998

[54] GAS RETAINING DEVICE

[75] Inventor: David H. Haynes, Manassas, Va.

[73] Assignee: The United States of America as represented by the Secretary of the Army, Washington, D.C.

[21] Appl. No.: 500,740

[22] Filed: Jul. 11, 1995

Related U.S. Application Data

[63] Continuation of Ser. No. 351,203, Nov. 30, 1994, abandoned.

[51] Int. Cl.[6] ..... A47G 1/10

[52] U.S. Cl. ..... 248/316.5; 248/313; 248/74.1

[58] Field of Search ..... 248/70, 74.1, 74.2, 248/67.5, 311.2, 316.5, 313; 403/97, 93, 105; 285/61

[56] References Cited

U.S. PATENT DOCUMENTS

| | | | |
|---|---|---|---|
| 139,174 | 5/1873 | Merrill | 403/95 |
| 814,690 | 3/1906 | Green | 403/95 |
| 3,270,994 | 9/1966 | Machan | 248/316.5 |
| 4,478,381 | 10/1984 | Pittion | 248/71 |
| 5,024,405 | 6/1991 | McGuire | 248/73 |
| 5,133,523 | 7/1992 | Daigle et al. | 248/62 |
| 5,167,392 | 12/1992 | Henricksen | 248/311.2 |
| 5,171,061 | 12/1992 | Marcusen | 248/311.2 |
| 5,344,112 | 9/1994 | Peterson et al. | 248/316.5 |
| 5,419,479 | 5/1995 | Evels | 248/316.2 |
| 5,489,054 | 2/1996 | Schiff | 248/311.2 |

FOREIGN PATENT DOCUMENTS

| | | | |
|---|---|---|---|
| 889181 | 12/1971 | Canada | 248/316.5 |
| 151902 | 3/1932 | Switzerland | 248/230.4 |
| 2080398 | 2/1982 | United Kingdom | 248/70 |
| 2189287 | 10/1987 | United Kingdom | 248/230.4 |

*Primary Examiner*—Ramon O. Ramirez
*Assistant Examiner*—Gwendolyn Baxter
*Attorney, Agent, or Firm*—Milton W. Lee; John E. Holford; Alain L. Bashore

[57] ABSTRACT

A retaining mechanism that includes an arcuate shaped securing arm rotatively coupled to at a pivot point to a fixedly mounted arcuate retaining member. The retaining mechanism allows for releasably securing a cylindrically shaped object until selectively released.

4 Claims, 3 Drawing Sheets

GAS RETAINING DEVICE

This application is a continuation of application Ser. No. 08/351,203, filed Nov. 30, 1994, abandoned.

BACKGROUND OF THE INVENTION

1. Field of the Invention

The present invention generally relates to gas cylinder holding mechanisms and more specifically, to a ratchet-type gas cylinder bracket securing mechanism.

2. Description of Prior Art

Gas cylinder holding mechanisms are used to safely, easily, and automatically secure gas cylinders to a fixed surface to prevent cylinder tip-overs. Cylinder brackets presently used involve the use of straps, chains, and expensive steel cages requiring the user to manually secure gas cylinders each time they are changed, relocated or transported.

The present types of cylinder securing devices require an unsafe situation because the user has to let go of the cylinder while manually installing the securing device. While the prior art has reported using securing devices none have established a basis for a specific apparatus that is dedicated to the task of resolving the particular problem at hand. What is needed in this instance is a gas cylinder holding mechanism that does not require the user to let go of the gas cylinder while securing the cylinder in place.

SUMMARY OF THE INVENTION

It is therefore one object of the invention to provide a gas retaining mechanism that does not require the user to let go of the gas cylinder while securing the cylinder in place.

There is disclosed a holding mechanism for the releasable securing of a gas cylinder in a substantially upright position while not requiring the user to let go of the gas cylinder when securing the cylinder in place. Two semi-circular arc shaped-liked securing arm elements engage with a rachet mechanism after approximating a securing position for the cylinder by bumper elements located on the inside surface of one of the securing elements. The other securing arm includes securing bumper elements for a cushioned secured position, with a pinch equal to the gas cylinder radius utilized times the square root of three.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
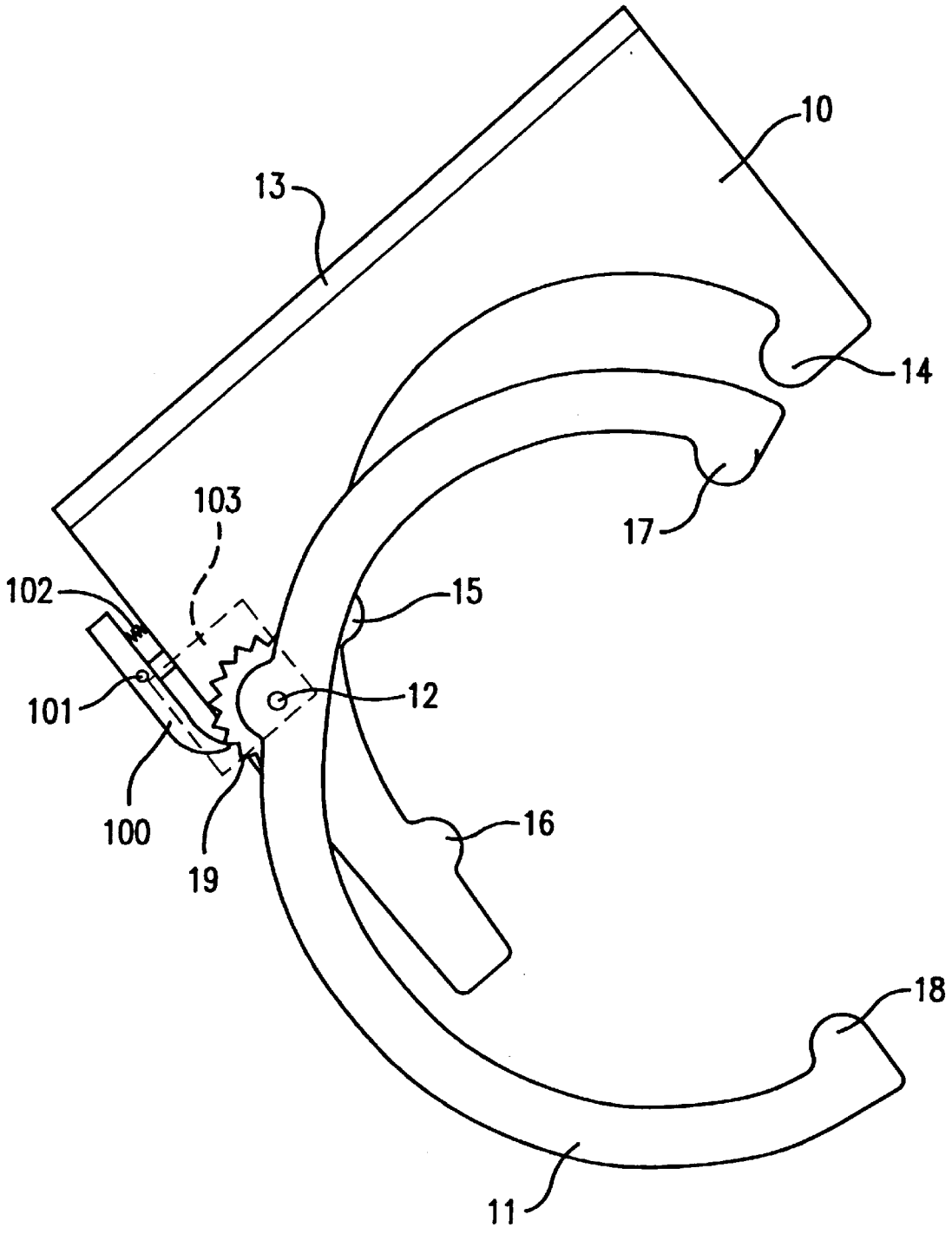
FIG. 1 is a front view of the present invention in the open position.

Referring now to the drawings, and more particularly to FIG. 1, there is shown a front view of the present invention in the open position. The bracket holding mechanism of the present invention includes mounting bracket 10 and a rotating securing arm 11 which pivots about pivoting point 12. Bracket 10 functions to mount the holding mechanism to a wall or other suitable surface at coupling points along side 13, stabilize a cylinder when first paced within the holding mechanism, and also to partially secure the cylinder. Mounting bracket 10 includes an inside surface shaped as a semicircular arc which includes three stabilizing bumpers 14, 15, and 16, each of which extend outward from the inside arc surface, all of which function to stabilize a gas cylinder when first placed into the holding mechanism, and two of which also partially secure the cylinder in place. Rotating securing arm 11 is shaped as a semi-circular arc, and includes securing bumpers 17 and 18 at each inside arc end. Rachet 19 which is integral with rotating securing arm 11 and rachet 19 functions with controller means 100 so as to releasably secure a gas cylinder in place within the holding mechanism. Controller means 100 pivots about pivot point 101 and is spring biased outward by bias means 102. Shield 103 covers rachet 19 and a portion of controller 100 so as to protect the user from moving parts. Shield 103 may be hinged or otherwise removable for ease of maintenance of rachet 19. When the user requires that rotating arm 11 be released from its position, the user would simply depress controller means 100 inward allowing the front portion of controller means 100 to swing away from the teeth of rachet 19.

Figure 2:
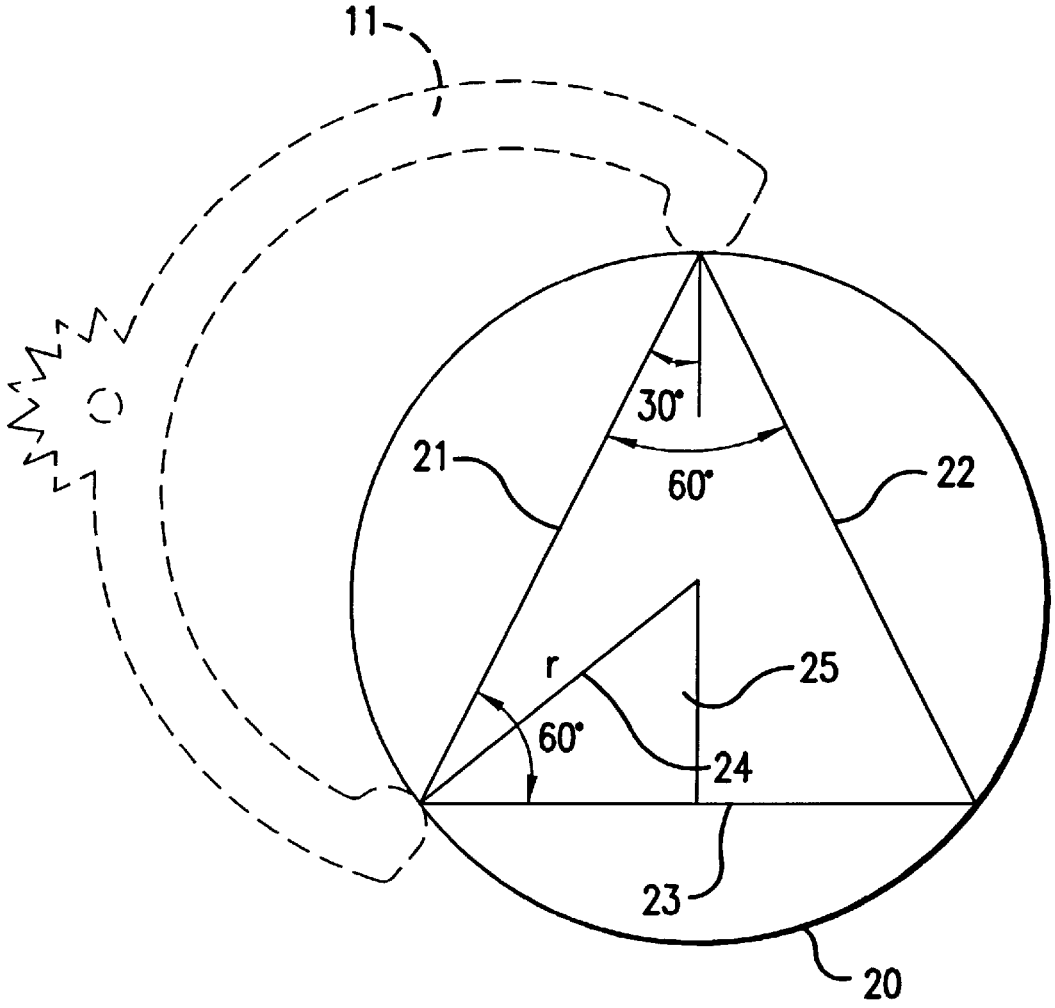
FIG. 2 is a front view of the rotating securing arm of the present invention in phantom, about a gas cylinder outline for a depiction of geometry relationship between pinch and cylinder size.

FIG. 2 is a front view of the rotating securing arm 11 of FIG. 1 in phantom, about a gas cylinder outline 20 shown in FIG. 2 for a depiction of the geometry relationship between pinch and cylinder size. Pinch p is defined as the shortest linear distance between respective outer surfaces of securing bumpers 17 and 18 shown in FIG. 1. As shown in FIG. 2, lines 21, 22 and 23 are all equal to each other and also to the pinch p. Line 24 is the radius r of cylinder 20. With such a geometry, the triangle 25 is established such that the following relationship is derived:

$$\text{Cos } 30° = \frac{P/2}{r}$$

$$P = 2r \text{ Cos } 30°$$

$$p = 2r\,(3/4)^{1/2}$$

$$p = r(3)^{1/2} \qquad (1)$$

Resultant equation (1) allows for the design of various rotating securing arms 11 depending on the desired maximum cylinder size required. For example, a maximum cylinder size of 10 inches would require a pinch of 8⅔ inches.

Figure 3:
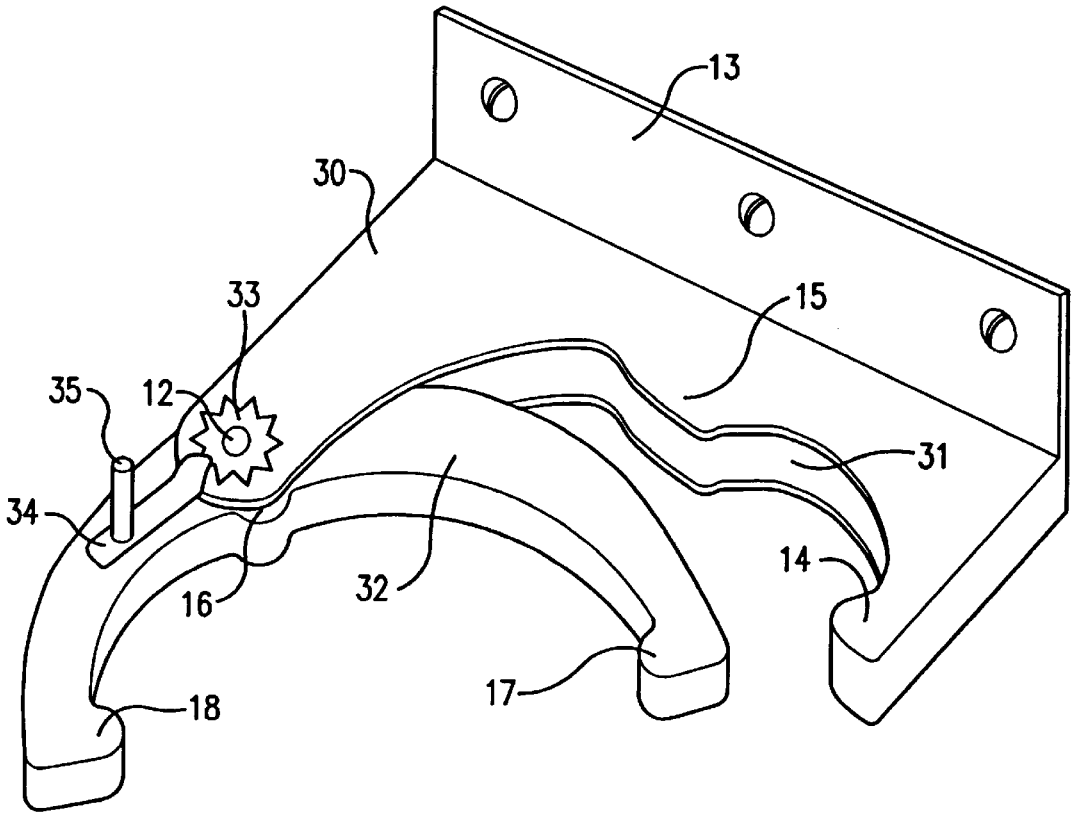
FIG. 3 is a front view of the present invention with a secured gas cylinder in the closed position.

FIG. 3 is a front view of the present invention with a secured gas cylinder 30. The present invention is utilized in the present embodiment as attached at side 13 along a wall with a conventional mounting utilizing common screws. The bracket mechanism initially is in the open position shown in FIG. 2. Gas cylinder 30 of FIG. 3 is initially placed in the general vicinity of mounting bracket 10 and slid up against stabilizing bumpers 14, 15, and 16. While the particular cylinder utilized may not be of a sufficient diameter to touch all three stabilizing bumpers, at least two of the stabilizing bumpers are touched by the cylinder outer surface so as to approximate the position of the cylinder within the bracket mechanism. Rotating securing bracket 11 is moved toward side 13 by movement of cylinder 30 so as to push securing bumper 17 away from the gas cylinder surface. After cylinder 30 is initially placed, the user depress controller 100, further swings rotating securing arm 11 against cylinder 30 if needed, and releases controller 100 so as to lock controller 100 in place, and thus also rotating securing arm 11.

When the user needs gas cylinder 30, all that is required is the depression of controller 100 with one hand, while the other hand may be placed on the cylinder itself. The bracket mechanism of the present invention is preferably made of non-corrosive material with sufficient overall strength so as safely secure the gas cylinder. The bumpers utilized would also further be resilient so as to absorb any cylinder placement or removal. All or some of the bumpers utilized may be also rotatable about their individual pivot points for additional ease of movement.

While this invention has been described in terms of preferred embodiment consisting of the bracket mechanism disclosed, those skilled in the art will recognize that the invention can be practiced with modification within the spirit and scope of the appended claims.

Having thus described my invention, what I claim as new and desire to secure by Letters Patent is as follows:

1. A retaining mechanism for releasably securing a cylindrically shaped object comprising:

a fixedly mounted arcuate retaining member for receiving and partially securing a cylindrically shaped object, said retaining member having upper and lower parallel plates defining a recess for accepting at least partially there within one end of an arcuate shaped securing arm;

an arcuate shaped securing arm having a pivot point located approximately one third the distance from one end of the securing arm, thereby effectively dividing said securing arm into a long section and a short section, independent of, but rotatively coupled at said pivot point and near one end of and to said fixedly mounted retaining member, whereby upon placing the cylindically shaped object to be secured within the inside portion of the arcuate securing arm, the pressure on the long section of the securing arm causes the securing arm to rotate about the pivot point and the short section of the securing arm then cradles and guides the cylindrically shaped object to be secured firmly into the arcuate retaining member, allowing the long section of the securing arm to rotate into said recess within said retaining member, said arcuate shaped securing arm further includes at least one protruding element extending radially inward and located on the end of the short section of said securing arm, to aid in confining the cylindrically shaped object, such that the cylindrically shaped object is encompassed within the confines of said retaining member and the arcuate shaped securing arm to thereby secure the cylindrical shaped object therein until selectively released;

means for rotatively coupling said fixedly mounted retaining member and said arcuate shaped securing arm at said pivot points for releasably holding any relative position between the retaining member and the securing arm as the securing arm rotates relative to the retaining member.

2. The retaining mechanism of claim 1 wherein said means for rotatively coupling is a ratchet mechanism including a ratchet and a movably mounted controller for releasable engagement to said ratchet.

3. The retaining mechanism of claim 2 wherein said ratchet is integral with said mounting arm, and positioned about said pivot points.

4. The retaining mechanism of claim 3 wherein said controller is movably mounted on said arcuate shaped securing arm, said controller further including a front portion for releasable engagement to said ratchet.

* * * * *